US006342258B1

(12) United States Patent
Berings et al.

(10) Patent No.: US 6,342,258 B1
(45) Date of Patent: Jan. 29, 2002

(54) BOIL-IN-BAG SACHET

(75) Inventors: Kristian Berings, Sint Truiden; Frieda Jacqueline Helene Sporen, Houthalen, both of (BE)

(73) Assignee: N. V. MasterFoods, S.A., Olen (BE)

( * ) Notice: Subject to any disclaimer, the term of this patent is extended or adjusted under 35 U.S.C. 154(b) by 0 days.

(21) Appl. No.: 09/280,381

(22) Filed: Mar. 29, 1999

(30) Foreign Application Priority Data

Apr. 1, 1998 (GB) ..... 9807037

(51) Int. Cl.[7] ..... B65D 81/34

(52) U.S. Cl. ..... 426/79; 426/82; 426/113; 426/123; 53/329; 206/5; 383/97; 383/207; 383/209

(58) Field of Search ..... 426/112, 113, 426/115, 122, 123; 383/103, 121, 207, 200, 104, 117, 97, 209; 53/329; 206/5

(56) References Cited

U.S. PATENT DOCUMENTS

| | | | | | |
|---|---|---|---|---|---|
| 2,103,389 | A | * | 12/1937 | Salfisberg | 222/107 |
| 2,145,941 | A | | 2/1939 | Maxfield | |
| 2,969,292 | A | * | 1/1961 | Heller | 426/113 |
| 3,081,174 | A | * | 3/1963 | Gay | 426/113 |
| 3,407,077 | A | * | 10/1968 | Helin | 426/110 |
| 3,615,712 | A | | 10/1971 | Keller | 99/171 H |
| 3,819,089 | A | | 6/1974 | Scales | 222/95 |
| 3,873,735 | A | | 3/1975 | Chalin et al. | 426/87 |
| 3,895,118 | A | | 7/1975 | Rambold | 426/83 |
| 4,278,198 | A | * | 7/1981 | Norton et al. | 229/55 |
| 4,290,521 | A | | 9/1981 | Mitchell | 206/0.5 |
| 4,365,629 | A | * | 12/1982 | Pert et al. | 128/214 D |
| 4,514,426 | A | * | 4/1985 | Jordan et al. | 426/113 |
| 4,605,123 | A | | 8/1986 | Goodrum et al. | 206/0.5 |
| 4,651,870 | A | | 3/1987 | Giambalvo | 206/0.5 |
| 4,787,755 | A | | 11/1988 | Branson | 383/65 |
| 4,796,300 | A | | 1/1989 | Branson | 383/63 |
| 4,869,912 | A | * | 9/1989 | McCoy et al. | 426/123 |
| 4,923,701 | A | | 5/1990 | VanErden | 426/113 |
| 5,044,777 | A | | 9/1991 | Watkins et al. | 383/100 |
| 5,222,813 | A | | 6/1993 | Kopp et al. | 383/200 |
| 5,366,741 | A | | 11/1994 | Van Der Zon | 426/79 |
| 5,419,437 | A | | 5/1995 | Huseman | 206/554 |
| 5,552,165 | A | | 9/1996 | Haak et al. | 426/80 |
| 5,613,779 | A | * | 3/1997 | Niwa | 383/201 |
| 5,863,585 | A | | 1/1999 | Sjöberg | 426/389 |
| 5,914,142 | A | * | 6/1999 | Zartner | 426/113 |
| 6,153,232 | A | * | 11/2000 | Holten et al. | 426/79 |

FOREIGN PATENT DOCUMENTS

| | | | | |
|---|---|---|---|---|
| DE | 7540166 | | | 4/1976 |
| DE | 4017363 | A1 | | 12/1991 |
| DE | 19716141 | A1 | | 10/1997 |
| EP | 0478812 | A1 | | 4/1992 |
| EP | 0499647 | A1 | | 8/1992 |
| EP | 0561654 | A1 | | 9/1993 |
| GB | 12680 | | | 10/1911 |
| GB | 1013665 | | | 12/1965 |
| GB | 2117350 | A | | 10/1983 |
| GB | 2171077 | A | | 8/1986 |
| GB | 2276138 | A | | 9/1994 |
| GB | 2283007 | A | | 4/1995 |
| JP | 5791164 | | | 11/1980 |
| JP | 410250747 | A | * | 9/1998 |
| WO | 92/06903 | | * | 4/1992 |

* cited by examiner

*Primary Examiner*—Nina Bhat
(74) *Attorney, Agent, or Firm*—Fulbright & Jaworski L.L.P.

(57) ABSTRACT

A boil-in-bag sachet is provided comprising top and bottom transverse seals, wherein the bottom transverse seal extends obliquely downwardly from at least one edge of the sachet that intersects an edge of the sachet at an angle of less than 90°, and preferably defining a bag-like or funnel-like bottom to the sachet, thereby improving drainage of water from within the sachet.

19 Claims, 4 Drawing Sheets

BOIL-IN-BAG SACHET

CROSS REFERENCE TO RELATED APPLICATIONS

This application claims priority to United Kingdom Application No. 9807037.8 filed Apr. 1, 1998.

FIELD OF THE INVENTION

The present invention relates to an easy to open and easy to handle boil-in-bag sachet.

BACKGROUND OF THE INVENTION

Boil-in-bag packages for food products are by now well known in the food packaging art. The packages are generally formed from thermoplastic materials and may be water-permeable or water-impermeable depending on the food product concerned. Water-permeable boil-in-bag packages are used where rehydration of a food product inside the package is required, e.g. boil-in-bag rice or pasta. Water-permeable boil-in-bag packages are generally pouches or sachets formed from perforated or reticulated thermoplastic film on conventional forming, filling and sealing equipment.

GB-A-2117350 describes a water permeable boil-in-bag pouch suitable for cooking rice. The pouch is manufactured from a single, overlapped web of a perforated thermoplastic film and has two parallel, spaced-apart transverse seals at the top of the pouch, and another two parallel, spaced-apart transverse seals at the bottom of the pouch. There are also two spaced-apart longitudinal seals, and a longitudinally extending region of overlapped film between the two longitudinal seals. The extent of this film overlap between the longitudinal seals is at least 2.54 cm. The top and/or the bottom of the pouch is provided with a horizontal aperture of at least 1.9 cm in length within the region of the film overlap and between the two transverse seals. The horizontal aperture provides a fork slot that allows the boil-in-bag pouch to be lifted from the boiling water in which it has been cooked without tearing the thermoplastic film.

A difficulty with boil-in-bag packaging for use in the home is that the packaging must normally be opened while the contents are still hot. This entails awkward manipulation of the hot package with consequent risk of spillage and/or scalding of the person manipulating the package. Moreover, an additional utensil, such as a knife or scissors, is needed to open the package.

EP-A-0478812 describes an easy-to-open package for food products useful for boil-in-bag or microwave packaging. The package comprises a sealed, flexible pouch with a thermoformed bottom web and a top web of mono-oriented material. A V-shaped precut is formed in the top web, whereby pulling on the precut results in tearing of the top web along the direction of orientation of the mono-oriented material, thereby opening the container. The precut is covered with an adhesive membrane patch which prevents leakage through the precut prior to opening the container, and which also operates as a starting pull tab for the opening. EP-A-0499647 describes a similar package to that described in EP-A0478812, except that the pull tab is formed as a precut in the upper one of two layers making up one part of the top web. This arrangement allows the adhesive membrane patch of EP-A-0478812 to be dispensed with. However, such packages are somewhat complex to manufacture and require the use of at least one web of mono-oriented plastic material.

GB-A-2283007 discloses a boil-in-bag sachet provided with two top and one bottom transverse seals. Between the two top transverse seals there is a fork slot that allows the boil-in-bag sachet to be lifted from the boiling water. Two lines of weakness, e.g. perforations, on opposite sides of the sachet define a tear strip in the sachet to assist opining of the sachet. The sachet also comprises a transverse line of weakness from the edge of the sachet to the lines of weakness to initiate tearing of the tear strip. A similar boil-in-bag sachet is described in DEA-19716141.

A drawback of all existing boil-in-bag sachets is that manipulation of the hot package is awkward due to the lack of a suitable handle on the sachet. Another problem associated with water-permeable boil-in-bag sachets is the sometimes irregular drainage of water from the boil-in-bag sachet after the cooking. A further problem is that food can get trapped in the comer of the boil-in-bag sachet when emptying out the contents of the boil-in-bag sachet.

SUMMARY OF THE INVENTION

It is an object of this invention to provide a water-permeable boil-in-bag sachet that is shaped in such a way as to allow for efficient drainage of the water after cooking.

It is also an object of the present invention to provide a boil-in-bag sachet that is easy to manipulate by providing a suitable handle on the boil-in-bag sachet. It is a further object of this invention to provide a boil-in-bag sachet that is shaped in such a way as to reduce the trapping of food in the comers of the boil-in-bag sachet when emptying its contents.

The present invention provides a boil-in-bag sachet comprising top and bottom transverse seals, wherein the bottom transverse seal extends obliquely downwardly from at least one edge of the sachet. The term "obliquely downwardly" signifies that the bottom seal is not a straight-line seal that extends horizontally across the sachet and intersects the edges of the sachet at right angles, as in all previous boil-in-bag sachets. The sachets according to the present invention have a bottom seal intersecting an edge of the sachet at an angle of less than 90°, and preferably defining a bag-like or funnel-like bottom to the sachet, thereby improving drainage of water from within the sachet.

The sachet is formed from one or more sheets of material that are bonded together by the top and bottom transverse seals. Preferably, the top and bottom transverse seals are substantially coplanar, whereby the sachet is preferably formed with a front and back faces and substantially coplanar side edges. More preferably, the side edges are substantially parallel. Preferably, the bottom transverse seal extends obliquely downwardly from both edges of the sachet, and more preferably the bottom transverse seal is substantially symmetrical about the longitudinal axis of the sachet.

The terms top and bottom and cognate expressions herein are relative terms, referring to first and second ends of the sachet respectively. In use, the bottom end of the sachet is normally the lower end of the sachet when the sachet is lifted from the pan of hot water for draining prior to opening.

The transverse seals may be heat seals or impulse seals, or even seals formed by adhesive bonding or stitching. The seals may be intermittent, broken, interrupted or discontinuous, provided that any gaps present in the seals are not so large as to allow the contents of the sachet to escape.

The top transverse seal may also extend obliquely upwardly from one or more edges of the sachet, in substantially similar fashion as described herein for the bottom transverse seal.

In a preferred embodiment of the present invention the bottom transverse seal extends in a curve downwardly and inwardly from at least one edge of the sachet.

In another preferred embodiment of the present invention the bottom transverse seal extends in a diagonal line downwardly and inwardly from said edge of the sachet. Preferably, the diagonal line is a substantially straight line. Most preferably, the bottom transverse seal comprises a diagonal portion extending downwardly and inwardly from an edge of the sachet, and a horizontal portion extending across a central portion of said sachet.

Preferably, the bottom transverse seal extends across a comer of the sachet, thereby defining a corner-tab for handling the sachet.

Preferably, the bottom transverse seal is substantially symmetrical about a central longitudinal axis of the sachet. Preferably, the bottom transverse seal intersects an edge of the sachet at an angle of from 20° to 70°, more preferably 30° to 60°, and most preferably about 45° to the longitudinal axis of the sachet. The bottom transverse seal may comprise diagonal elements that also intersect the bottom edge of the sachet.

The boil-in-bag sachet may be opened by cutting or tearing, and may be provided with one or more tear starts such as nips in the top edge of the sachet. Preferably, the boil-in-bag sachet has a pair of longitudinal lines of weakness extending from the top transverse seal to the bottom transverse seal and defining a tear strip in the sachet. Most preferably, the boil-in-bag sachet has two pairs of said longitudinal lines of weakness defining two tear strips.

Preferably, the lines of weakness of each said pair extend substantially parallel to each other, and more preferably on opposite sides of the sachet adjacent to a longitudinal edge of the sachet. Preferably, the lines of weakness are lines of perforations.

The lines of weakness may be associated with a transverse cut extending from the edge of the sachet to one of the lines of weakness and defining a tear tab to initiate tearing along the lines of perforations, as defined in DE-A-19716141. Preferably, the lines of weakness have a nip proximate to their top and/or bottom end to guide the user's eye to the position of the lines of perforations, and to help the user initiate tearing of the tear strip. More preferably, said nip is a substantially triangular or trapezoidal cut-out extending downwardly from the top edge or upwardly from the bottom edge of the boil-in-bag sachet. The nip is preferably formed by cutting a continuous stream of sachets, such as are formed on a vertical form/fill/seal machine, using a suitably shaped knife or die cutter. This may result in the formation of sachets having projecting tabs equal in size and shape to the nips, on the bottom or top of the sachet.

Preferably, the boil-in-bag sachet according to the present invention is also provided with a second transverse top seal longitudinally spaced from the first transverse top seal and/or a second transverse bottom seal longitudinally spaced from the first transverse bottom seal. Preferably, the sachet comprises a fork slot for lifting the sachet. Preferably the fork slot is located between the first and second transverse top and/or bottom seals, preferably near the longitudinal mid-line of the sachet.

Preferably, the boil-in-bag sachet is water-permeable and contains a rehydratable food product. Preferably, the sachet is formed from a single web or tube of film material, which is preferably a thermoplastic film material. Preferably, a web of film material is overlapped and bonded by a longitudinal seal, for example by conventional form/fill/seal equipment. Where a thermoplastic film material is used, the longitudinal seal and the top and bottom transverse seals are preferably impulse seals or heat seals.

Preferably the boil-in-bag sachet according to the present invention is formed from a single web of material. Preferably the sachet is formed, from foraminous material, such as a perforated or reticulated web. This provides for maximum water permeability of the sachet, which is desirable for cooking rehydratable foodstuffs such as rice, pasta, grains or beans. Preferably the sachet contains one or more such foodstuffs, and most preferably the sachet contains rice. The sachet material may also be embossed. Typically, the sachet material comprises a thermoplastic film, such as a polyethylene or polypropylene film, and has a base sheet thickness of less than 60 $\mu$m, preferably 10 to 50 $\mu$m, more preferably 20 to 40 $\mu$m and most preferably about 30 $\mu$m. Preferably, the sachet is substantially translucent, and more preferably it is substantially transparent.

The boil-in-bag sachet according to the present invention is preferably formed from a continuous web of thermoplastic material using conventional vertical form/fill/seal techniques well know to those skilled in the art and described, for example, in U.S. Pat. No. 2,145,941. Preferably, the lines of perforations are provided in the continuous web of thermoplastic material before it is formed into the sachet, for example by use of a pre-perforated film. Preferably, the equipment is modified to provide the lines of perforation. For example, in certain embodiments the lines of perforations are provided by means of a rotating perforation knife forming a continuous line of perforations extending longitudinally along the continuous web of thermoplastic material. Preferably, the oblique transverse bottom seal is provided by means of a suitably shaped impulse sealing or heat sealing jaw or a plurality of sealing jaws in one or more heat sealing steps before filling of the sachet.

BRIEF DESCRIPTION OF THE DRAWINGS

Specific embodiments of the invention will now be described further, by way of example, with reference to the accompanying drawings, in which.

DETAILED DESCRIPTION OF THE PREFERRED EMBODIMENTS

Figure 1:
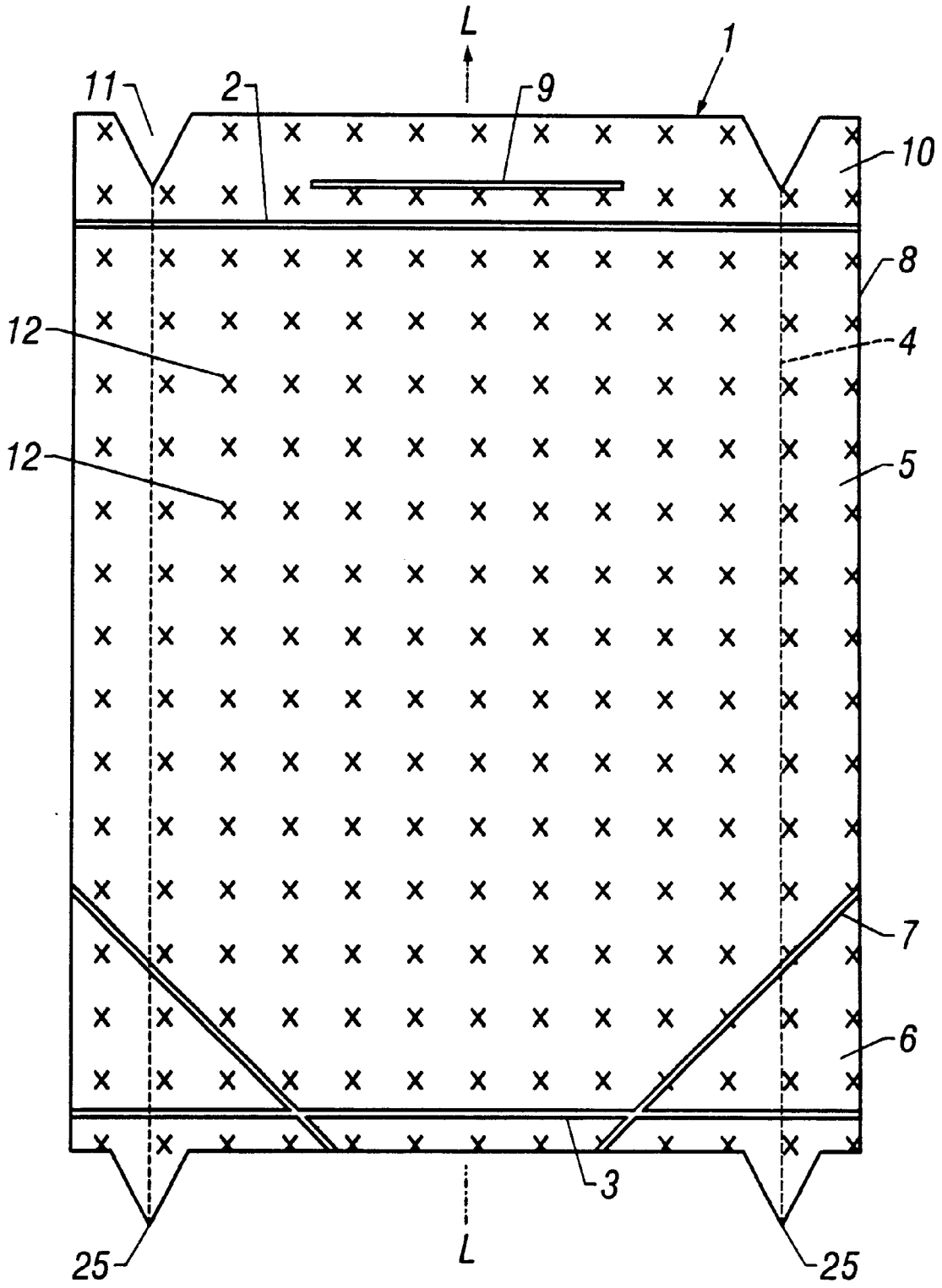
FIG. 1 shows a side view of a boil-in-bag sachet according to the present invention.

Referring to FIG. 1, the boil-in-bag sachet (1) is formed from a single web of a heat-sealable thermoplastic film material, which is a perforated polyethylene film. The film base sheet thickness is 34 $\mu$m. The film is water permeable by virtue of perforations (12). The perforations (12) are so-called "star punctures" formed on a 9 mm×9 mm square grid pattern as described further below.

The sachet (1) contains parboiled rice grains dried to microbiological stability of 10–12 wt. % moisture. The sachet (1) is sealed by means of transverse top (2) and bottom heat seals. A longitudinal heat seal (not shown) extends up an overlapped region of the film extending along the back of the sachet (1) to complete the sealing of the sachet (1).

The bottom heat seal comprises a transverse horizontal seal (3) intersecting diagonal portions (7) extending downwardly and inwardly from the edges (8) of the sachet (1) to provide a funnel like bottom to the sachet. The diagonal portions (7) are straight and at a 45° angle to the transverse portion (3) and to the longitudinal axis (L) of the sachet. Hence, diagonal portions (7) extend across the bottom corners of the sachet (1) in such a way as to form triangular corner-tabs (6) for convenient handling of the sachet (1).

Two lines of weakness (4) extend in straight lines up the front of the sachet between the top (2) and bottom (3) transverse heat seals and parallel to edges (8) of the sachet (1). Two lines of weakness (not shown) extend up the back of the sachet and are directly overlapped by the two lines of weakness (4) at the front of the sachet. The lines of weakness are lines of perforations formed as closely spaced rows of punctures that permit easy tearing of the thermoplastic film along the lines of perforations. Tearing along a pair of lines of weakness (4) detaches a rectangular tear strip (5) from the sachet (1).

The lines of weakness (4) are provided with nips (11) at the top ends. Said nips (11) are V-shaped cut-outs extending downwardly from the top edge of the boil-in-bag sachet (1) towards but not reaching the transverse top seal (2). The nips (11) are used to initiate tearing along the longitudinal lines of weakness (4). Matching projecting tabs (25) project from the bottom of the sachet. This is the leftover material from cutting out the nips (11).

A fork slot (9) approximately 2.5 cm long is provided by a lateral cut above the top transverse heat seals.

Figure 2:
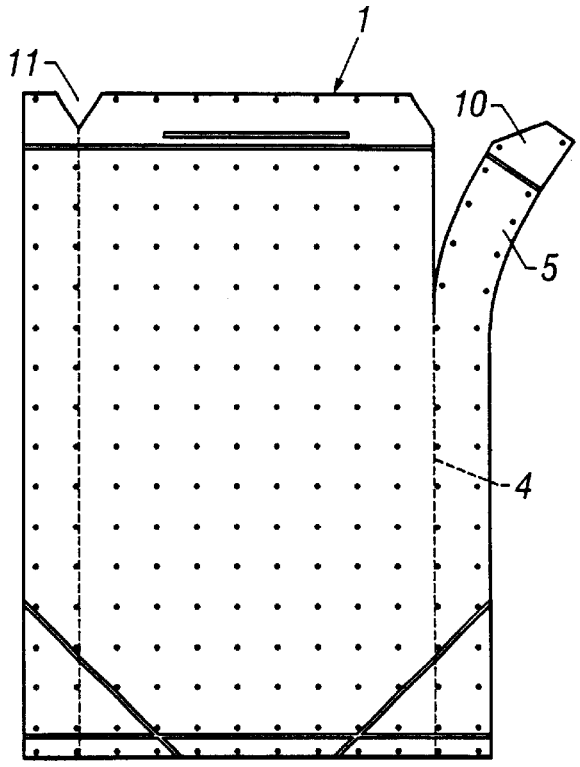
FIG. 2 shows the same boil-in-bag sachet with the tear strip partially detached.

Referring to FIGS. 1 and 2, the rice in the sachet (1) is cooked by immersing the sachet (1) in boiling water for the appropriate cooking time. The sachet (1) is then removed from the boiling water by inserting a fork or other utensil in the fork slot (9) and lifting. Excess water is allowed to drain from the sachet (1), the bottom transverse heat seal allowing for efficient drainage of the water. The diagonal portions (7) of the bottom transverse heat seal act as a funnel to provide more uniform drainage of the water. The lack of rectangular bottom corners ensures that no water is trapped. The sachet (1) is then opened by grasping one of the corner-tabs (6) and the top (10) of one of the tear strips (5) and by pulling downwardly and outwardly. The corner-tabs (6) are less hot and less wet than the body of the sachet, and therefore allow for easy emptying of the sachet (1) by grasping a corner-tab to invert the sachet. Once the tear strip (5) has been partially or completely detached, the cooked rice can be poured easily from the sachet (1), the provision of the diagonal portions (7) of the bottom transverse heat seal ensuring that no rice is trapped in the bottom corners.

Figure 3:
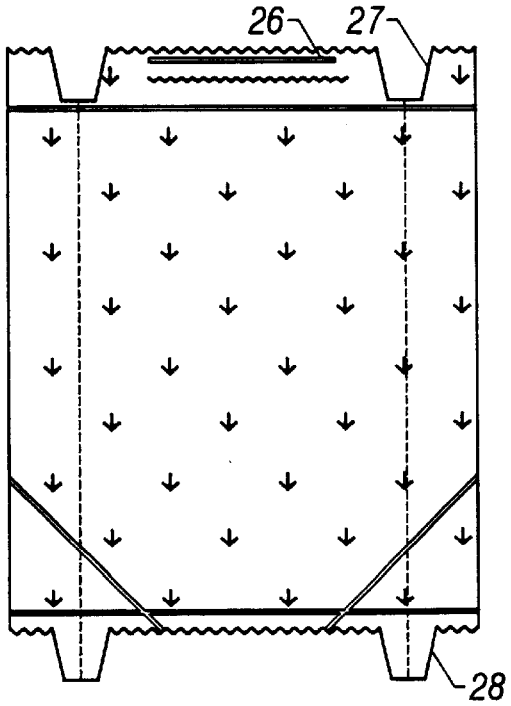
FIG. 3 shows a first alternative boil-in-bag sachet according to the present invention.

Referring to FIG. 3, an alternative embodiment is shown, similar to that of FIGS. 1 and 2, but further comprising a second transverse top seal (26) extending across a central portion of the sachet above the fork slot (9). The second transverse top seal makes it easier to insert a fork or other utensil into the fork slot after cooking. The embodiment of FIG. 3 also comprises trapezoidal-shaped nips (27) instead of the triangular nips (11) of FIG. 1. The trapezoidal nips (27) are easier to align with the lines of perforations in the manufacturing process. Corresponding trapezoidal waste flaps (28) project from the bottom edge of the sachet.

Figure 4:
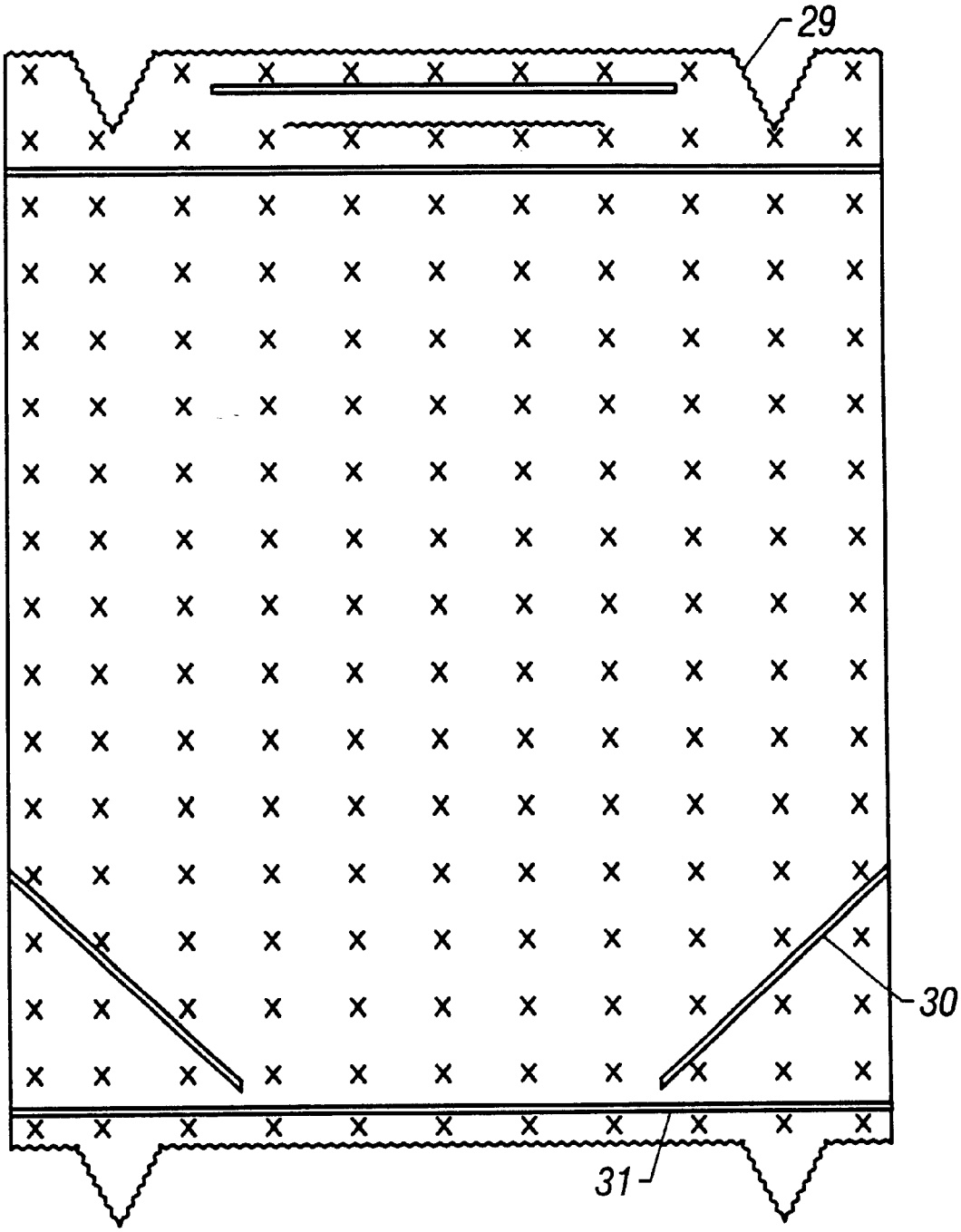
FIG. 4 shows a second alternative boil-in-bag sachet according to the present invention.

Referring to FIG. 4, an alternative embodiment is shown, similar to that of FIG. 3, but without the longitudinal lines of perforations. Instead, opening of the sachet is initiated by tearing using the nips (29) as tear starts. The bottom seal of the sachet comprises a linear transverse portion (31) extending from side to side of the sachet and two diagonal portions (30) extending downwardly and inwardly from opposed sides of the sachet almost to the transverse portion (31), but not quite intersecting the transverse portion (31). This arrangement provides good liquid drainage from the sachet.

Figure 5:
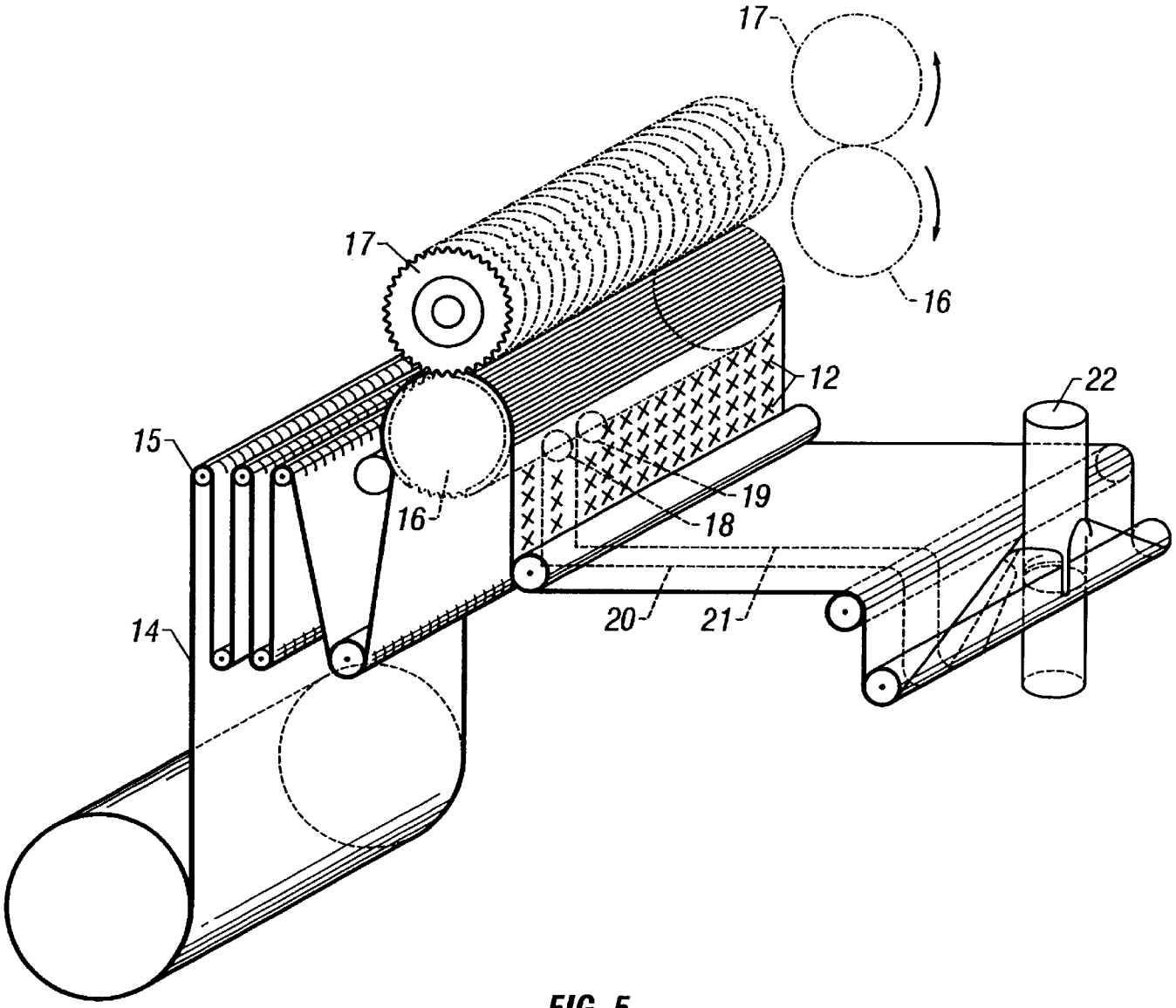
FIG. 5 shows a schematic view of the apparatus used to form the sachet of FIGS. 1 or 3.

Referring to FIG. 5, the boil-in-bag rice sachet is made using a modified vertical form/fill/seal process. A continuous web (14) of thermoplastic material passes through an accumulator (15) and then over resilient roller (16). A perforating roller (17) presses into the resilient roller (16) through the web (14) and thereby forms perforations (12) in the continuous web (14) in order to make it water-permeable. Specifically, the perforating roller (17) is provided on its surface with projections in the shape of triangular pyramids that pierce the continuous web (14) forming so-called "star punctures" in a 9 mm×9 mm square grid over substantially the whole of the web. The star punctures provide water permeability, but are spaced too far apart to provide easy tearing of the web material.

Two perforation cutters (18, 19) in the form of rotating discs having serrated edges also press into the resilient roller (16) through the web (14) and thereby cutting two lines of closely spaced, tearable perforations (20, 21) extending longitudinally along the web (14). The web (14) is then wrapped around a filling tube (22) and sealed at the bottom using a suitably shaped bottom heat sealing jaw or jaws to provide the bottom transverse heat seal (3). The sachet (1) then undergoes conventional vertical filling and sealing at the top to produce the boil-in-bag rice sachet (1). Successive sachets are detached using a suitably shaped hot wire, hot knife or die cutter to form the nips (11, 26) and corresponding waste tabs (25, 28).

Accordingly, it can be seen that the improved boil-in-bag sachets according to the present invention are easy to make, requiring only a slight modification of existing manufacturing processes.

The above embodiments of the present invention have been described by way of example only. Many other embodiments falling within the scope of the accompanying claims will be apparent to the skilled reader.

What is claimed is:

1. A boil-in-bag sachet for rehydrating a food product by immersion in water comprising a tubular pouch formed from a water-permeable perforated film, a top and bottom edge, coplanar side edges, and separate top and bottom transverse seals, the bottom transverse seal including a diagonal portion extending downwardly and inwardly from at least one side edge and a horizontal portion extending across a central portion of the bottom edge of the sachet, the sachet having a central longitudinal axis, whereby the diagonal portion of the bottom transverse seal facilitates drainage of water through the perforated film while preventing a portion of the food product from being trapped along the transverse seals when the sachet is removed from the water.

2. A boil-in-bag sachet according to claim 1, wherein the diagonal portion extends downwardly and inwardly from both side edges of the sachet.

3. A boil-in-bag sachet according to claim 1, wherein the bottom transverse seal extends across a corner of the sachet, thereby defining a corner-tab for handling the sachet.

4. A boil-in-bag sachet according to claim 1, wherein the bottom transverse seal is symmetrical about a central longitudinal axis of the sachet.

5. A boil-in-bag sachet according to claim 1, wherein the bottom transverse seal intersects at least one edge of the sachet at an angle of 20° to 70° to the longitudinal axis of the sachet.

6. A boil-in-bag sachet according to claim 5, wherein the bottom transverse seal intersects at least one edge of the sachet at an angle of 45° to the longitudinal axis of the sachet.

7. A boil-in-bag sachet according to claim 1, wherein the boil-in-bag sachet includes a pair of longitudinal lines of weakness extending from the top transverse seal to the bottom transverse seal and defining at least one tear strip in the sachet.

8. A boil-in-bag sachet according to claim 7, wherein the boil-in-bag sachet has two pairs of longitudinal lines of weakness extending from the top transverse seal to the bottom transverse seal and defining two tear strips in the sachet.

9. A boil-in-bag sachet according to claim 7, wherein the lines of weakness of each said pair extend parallel to each other on opposite sides of the sachet and adjacent to the two edges of the sachet.

10. A boil-in-bag sachet according to claim 7, wherein the lines of weakness include a nip proximate to their top end.

11. A boil-in-bag sachet according to claim 10, wherein the nip is a V-shaped cut-out.

12. A boil-in-bag sachet according to claim 7, wherein the lines of weakness have a nip proximate to their bottom end.

13. A boil-in-bag sachet according to claim 12, wherein the nip is a substantially V-shaped cut-out.

14. A boil-in-bag sachet (1) according to claim 7, wherein the lines of weakness are lines of perforations.

15. A boil-in-bag sachet according to claim 1, further comprising a second transverse top seal longitudinally spaced from the first transverse top seal, and wherein the boil-in-bag sachet is further provided with a fork slot between the first and second transverse top seals.

16. A boil-in-bag sachet according to claim 1, wherein the boil-in-bag sachet is formed from a single web of film material.

17. A boil-in-bag sachet according to claim 1, wherein the sachet is formed from a thermoplastic film and the top and bottom transverse seals comprise impulse seals or heat seals.

18. A boil-in-bag sachet according to claim 1, wherein the sachet contains a rehydratable food product.

19. A boil-in-bag sachet for rehydrating a food product by immersion in water comprising a tubular pouch formed from a water-permeable perforated film, a top and bottom edge, coplanar side edges, and separate top and bottom transverse seals, the bottom transverse seal including a diagonal portion extending downwardly and inwardly from each side edge whereby the diagonal portion of the bottom transverse seal facilitates drainage of water through the perforated film while preventing a portion of the food product from being trapped along the transverse seals when the sachet is removed from the water.

* * * * *